US010534301B2

(12) United States Patent
Yuasa

(10) Patent No.: US 10,534,301 B2
(45) Date of Patent: Jan. 14, 2020

(54) MEDIUM SUPPLY DEVICE AND IMAGE FORMING APPARATUS

(71) Applicant: Oki Data Corporation, Minato-ku, Tokyo (JP)

(72) Inventor: Hiroshi Yuasa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/601,238

(22) Filed: May 22, 2017

(65) Prior Publication Data

US 2017/0368843 A1 Dec. 28, 2017

(30) Foreign Application Priority Data

Jun. 27, 2016 (JP) ..... 2016-126347

(51) Int. Cl.

| | |
|---|---|
| ***B41J 13/10*** | (2006.01) |
| ***G03G 15/00*** | (2006.01) |
| ***B65H 3/52*** | (2006.01) |
| ***B65H 1/26*** | (2006.01) |
| ***B65H 1/04*** | (2006.01) |

(52) U.S. Cl.

CPC ..... *G03G 15/6502* (2013.01); *B65H 1/04* (2013.01); *B65H 1/266* (2013.01); *B65H 3/52* (2013.01); *B41J 13/103* (2013.01); *B65H 2405/313* (2013.01); *B65H 2405/361* (2013.01); *B65H 2407/21* (2013.01); *B65H 2701/1916* (2013.01)

(58) Field of Classification Search

CPC .... B41J 11/006; B41J 11/0045; B41J 13/009; B41J 11/22; B41J 13/14; B41J 13/103; G03G 15/6502; B65H 3/52; B65H 1/266; B65H 1/04; B65H 2701/1916; B65H 2407/21; B65H 2405/361; B65H 2405/313

See application file for complete search history.

(56) References Cited

U.S. PATENT DOCUMENTS

2009/0079125 A1* 3/2009 Yuasa ..... B65H 3/5223 271/109
2014/0353905 A1* 12/2014 Takahata ..... B65H 3/0684 271/121

FOREIGN PATENT DOCUMENTS

JP 2014234263 A 12/2014
JP 2015-086028 * 5/2015 ..... B65H 3/52
JP 2015127250 A 7/2015

* cited by examiner

*Primary Examiner* — Yaovi M Ameh
(74) *Attorney, Agent, or Firm* — Panitch Schwarze Belisario & Nadel LLP

(57) ABSTRACT

Provided is an apparatus that can reduce a braking force of a medium separating mechanism to thereby reduce occurrence of paper jams only by attaching a medium supply device to an image forming apparatus body. The medium supply device is configured to be attached to an image forming apparatus body including a medium separating mechanism, and includes a medium conveying mechanism that supplies a recording medium from stacked recording media to a predetermined position, and first mechanism that reduces a braking force generated in the medium separating mechanism.

18 Claims, 9 Drawing Sheets

MEDIUM SUPPLY DEVICE AND IMAGE FORMING APPARATUS

BACKGROUND OF THE INVENTION

1. Field of the Invention

The present invention relates to a medium supply device configured to be attached to an image forming apparatus and an image forming apparatus including a medium supply device.

2. Description of the Related Art

Conventionally, an image forming apparatus including a multi-purpose tray (MPT) section has been widely used (see, for example, Japanese Patent Application Publication No. 2015-127250). A medium to be conveyed from the MPT section to the image forming apparatus body (also referred to as an "apparatus body") is separated by a medium separating mechanism.

In some apparatuses, the MPT section has a structure that enables removable attachment (installation) of a medium supply device (paper feed device) on which recording media (special media) having special shapes such as envelopes are stacked. The attachment (installation) of the medium supply device enables these apparatuses to perform continuous printing on the special media such as envelopes. For example, special media supplied from the medium supply device are sequentially conveyed to an image forming unit (printing unit) in the apparatus body through a medium receiving port and the medium separating mechanism.

In the case of attaching the medium supply device to the MPT section to supply the special media (e.g., envelopes), however, an excessive braking force (which is a force acting in a direction opposite to a conveying direction) might be applied from the medium separating mechanism to the special media in some cases. In such cases, flaps of the envelopes as the special media are lifted or the like occur, and therefore paper jams easily occur.

SUMMARY OF THE INVENTION

It is an object of the present invention to provide a medium supply device and an image forming apparatus that can reduce a braking force of a medium separating mechanism and therefore can reduce occurrence of paper jams only by attaching the medium supply device to an image forming apparatus body.

A medium supply device according to an aspect of the present invention is configured to be attached to an image forming apparatus body including a medium separating mechanism, and the medium supply device includes: a medium conveying mechanism that supplies a recording medium from stacked recording media to a predetermined position; and a first mechanism that reduces a braking force generated in the medium separating mechanism.

According to the present invention, a braking force of the medium separating mechanism can be reduced so that occurrence of paper jams can be reduced by attaching the medium supply device to the image forming apparatus body.

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

Medium supply devices (paper feed devices) and image forming apparatuses each including a medium supply device according to embodiments of the present invention will be described hereinafter with reference to the accompanying drawings. To facilitate understanding of relationships among the drawings, the drawings show coordinate axes of an xyz orthogonal coordinate system. The x axis is a coordinate axis indicating a depth direction (which is a width direction of recording media) of the image forming apparatus. The y axis is a coordinate axis indicating a width direction (which is a conveying direction of recording media in an image forming unit) of the image forming apparatus. The z axis is a coordinate axis indicating a height direction of the image forming apparatus.

<1> First Embodiment

<1-1> Configuration

Figure 1:
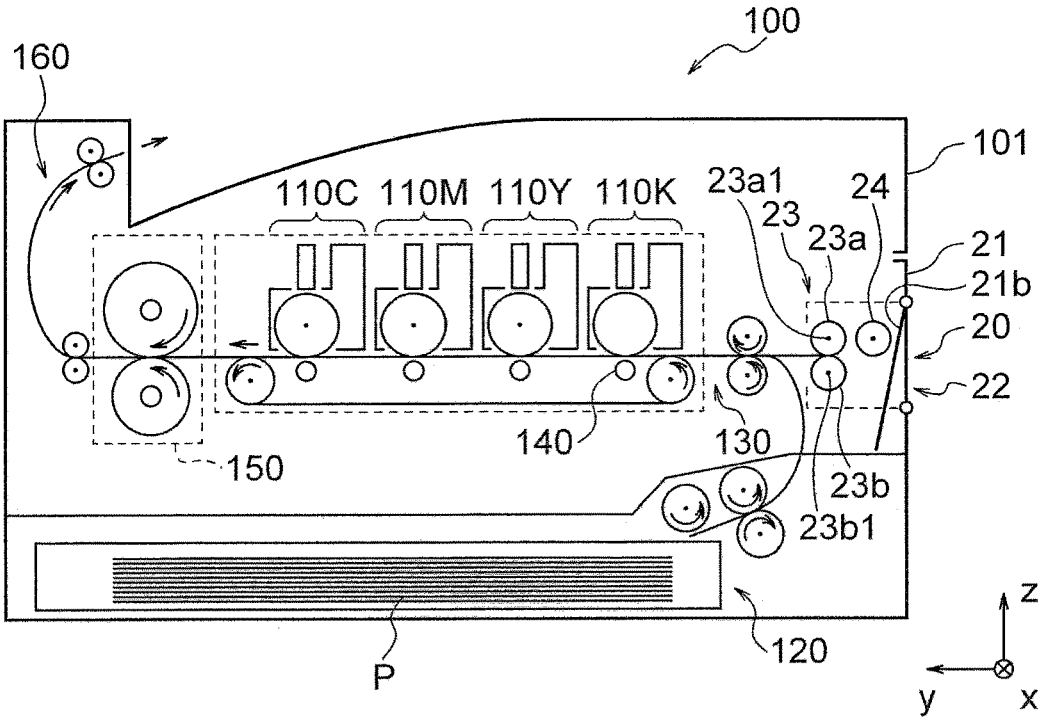
FIG. 1 is a cross-sectional view illustrating a schematic configuration of an image forming apparatus including an MPT section to which a medium supply device according to a first embodiment of the present invention can be attached (when an MPT tray of the MPT section is closed)
Figure 2:
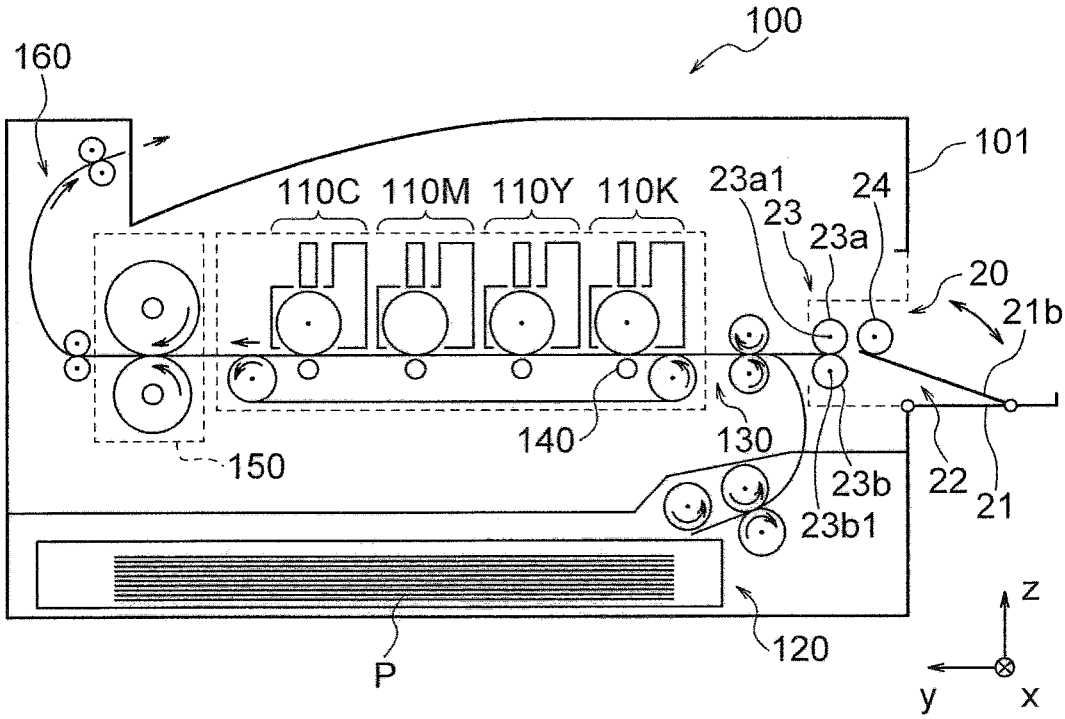
FIG. 2 is a cross-sectional view illustrating a schematic configuration of the image forming apparatus including the MPT section to which the medium supply device according to the first embodiment can be attached (when the MPT tray of the MPT section is open)

First, with reference to FIGS. 1 through 3, an image forming apparatus 100 including an MPT section 20 to which a medium supply device according to the first embodiment can be attached will be described. FIG. 1 is a cross-sectional view illustrating a schematic configuration of the image forming apparatus 100 including the MPT section 20 to which the medium supply device according to the first embodiment can be attached (when an MPT tray 21 of the MPT section 20 is closed). FIG. 2 is a cross-sectional view illustrating a schematic configuration of the image forming apparatus 100 including the MPT section 20 to which the medium supply device according to the first embodiment can be attached (when the MPT tray 21 of the MPT section 20 is open). Further, FIG. 3 is a cross-sectional view schematically illustrating a state of a medium separating mechanism (e.g., friction separating mechanism) 23 and a pickup roller 24 in a case where recording media (paper sheets) P stacked on a sheet receiver 21*b* of the MPT tray (also referred to as a "tray" or a "manual feed tray") 21 illustrated in FIG. 2 are supplied one by one.

As illustrated in FIGS. 1 and 2, the image forming apparatus 100 includes, as main components, image forming units 110K, 110Y, 110M, and 110C that form developer images (toner images) by electrophotography. In each of the image forming units 110K, 110Y, 110M, and 110C, the surface of a photosensitive drum serving as an image carrier is exposed to light with a light-exposure device (e.g., an LED array) to form an electrostatic latent image, and the electrostatic latent image is developed with a developing device to form a toner image. The image forming apparatus 100 also includes a medium supply section (paper feed section) 120 that supplies a recording medium P to a conveyance path facing the image forming units 110K, 110Y, 110M, and 110C, a conveying section 130 that conveys the recording medium P, transfer rollers 140 serving as transfer sections that transfer, onto the recording medium P, the toner images formed on the photosensitive drums in the image forming units 110K, 110Y, 110M, and 110C, and a fixing unit 150 that applies heat and pressure to the toner images transferred onto the recording medium P so that the toner images are fixed on the recording medium P. The image forming apparatus 100 also includes a medium ejecting section 160 including rollers for ejecting the recording medium P that has passed through the fixing unit 150 to the outside of an image forming apparatus body (i.e., apparatus body) 101. FIGS. 1 and 2 illustrate the four image forming units 110K, 110Y, 110M, and 110C using black (K) toner, yellow (Y) toner, magenta (M) toner, and cyan (C) toner. However, the number of image forming units included in the image forming apparatus 100 may be three or less or five or more. Although the image forming apparatus 100 illustrated in FIGS. 1 and 2 is a printer, the present invention is also applicable to other types of apparatus, such as a copying machine, a facsimile machine, or a multifunction peripheral (MFP), as long as the apparatus forms (prints) an image on a recording medium.

Figure 3:
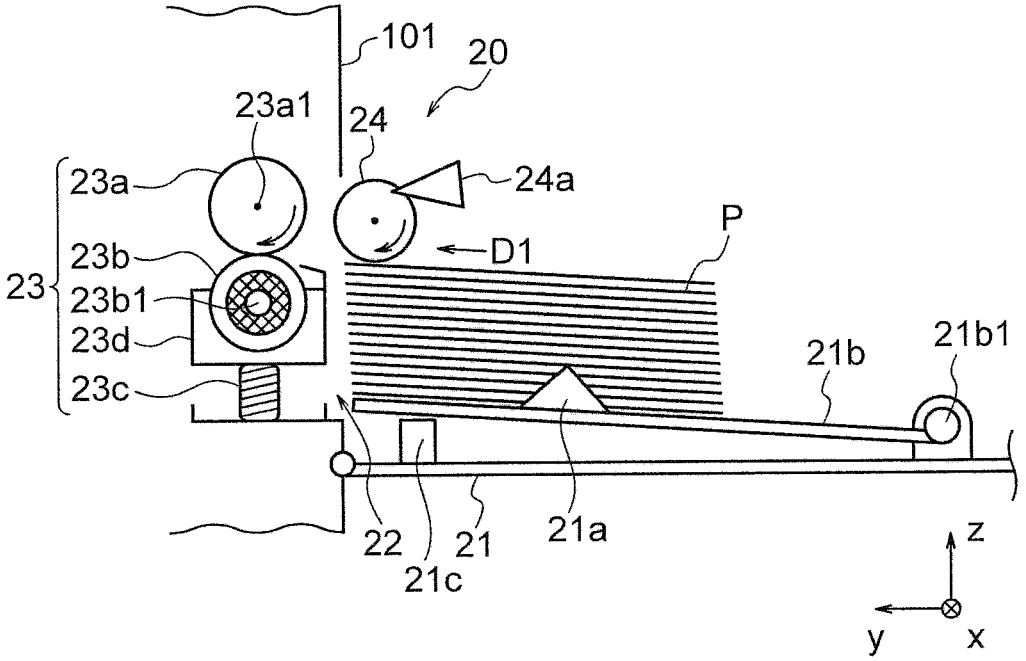
FIG. 3 is a cross-sectional view schematically illustrating a state of a medium separating mechanism in a case where recording media stacked on the MPT tray in an open state are supplied one by one.

As illustrated in FIGS. 1 through 3, the apparatus body 101 of the image forming apparatus 100 includes the MPT section 20 to which the medium supply device (illustrated in FIGS. 4 through 6 which will be described later) according to the first embodiment can be attached. The MPT section 20 includes the medium receiving port 22, the MPT tray 21 that opens and closes the medium receiving port 22, and the medium separating mechanism 23. The medium separating mechanism 23 includes a feed roller 23*a* serving as a paper feed roller (first roller) and a retard roller 23*b* serving as a separating roller (second roller). The feed roller 23*a* and the retard roller 23*b* have outer peripheral surfaces that are in contact with each other. The feed roller 23*a* is fixed to a support shaft (shaft) 23*a*1. The support shaft 23*a*1 is rotatably supported on the apparatus body 101. The retard roller 23*b* is fixed to a support shaft (shaft) 23*b*1. The support shaft 23*b*1 is rotatably supported on a support unit (attachment frame) 23*d*. The support unit 23*d* is movable in a z direction with respect to the apparatus body 101, and a pressing force is applied to the support unit 23*d* in an upward direction (+z direction) in the drawing by a compression spring 23*c* serving as an elastic member. In this manner, the compression spring 23*c* applies the pressing force (a force in the direction) toward the feed roller 23*a* to the retard roller 23*b* through the support unit 23*d*.

As illustrated in FIG. 3, the MPT section 20 includes the pickup roller 24 that feeds the recording media P stacked on the sheet receiver 21*b* of the MPT tray 21 in the open state one by one from the uppermost medium in the conveying direction D1, and also includes a position sensor 24*a* serving as a detector that detects the position of the pickup roller 24 in the z direction. The support shaft 24*b* of the pickup roller 24 is supported in such a manner that the support shaft 24*b* can move in the z direction (i.e., move up and down) relative to the apparatus body 101. The MPT tray 21 in the open state includes, in an upper portion of the MPT tray 21, the sheet receiver 21*b* serving as a lift plate that rotates (swings) about a support shaft 21*b*1 and lifts the recording medium P and a pressure sensor 21*a* serving as a medium detector that can detect the presence or absence of a recording medium P on the sheet receiver 21*b*. The pressure sensor 21*a* is a sensor disposed on the sheet receiver 21*b*. The MPT section 20 includes an elevation mechanism 21*c* that elevates and lowers the sheet receiver 21*b* according to a result of detection (the presence or absence of the recording medium P) output by the pressure sensor 21*a*. The elevation mechanism 21*c* is caused to operate by a driving mechanism such as a motor, which is not illustrated, for example.

Figure 4:
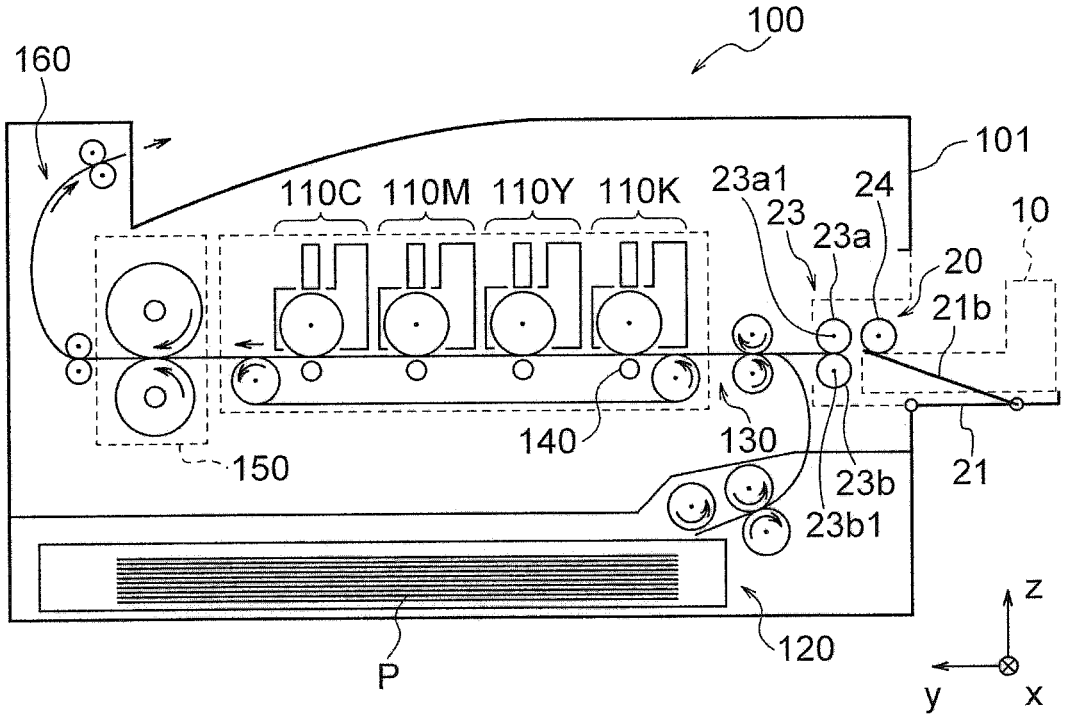
FIG. 4 is a cross-sectional view illustrating a schematic configuration of the image forming apparatus in which the medium supply device according to the first embodiment is attached to the MPT section.

FIG. 4 is a cross-sectional view illustrating a schematic configuration of the image forming apparatus 100 in which the medium supply device 10 according to the first embodiment is attached to (installed in) the MPT section 20. Instead of stacking the recording media P in the MPT section 20 as illustrated in FIG. 3, the medium supply device 10 according to the first embodiment can be attached to the MPT section 20 as illustrated in FIG. 4. In the case of attaching the medium supply device 10, the recording media (e.g., special media such as envelopes) stacked on the medium supply device 10 can be supplied one by one to the image forming units in the image forming apparatus body 101.

Figure 5:
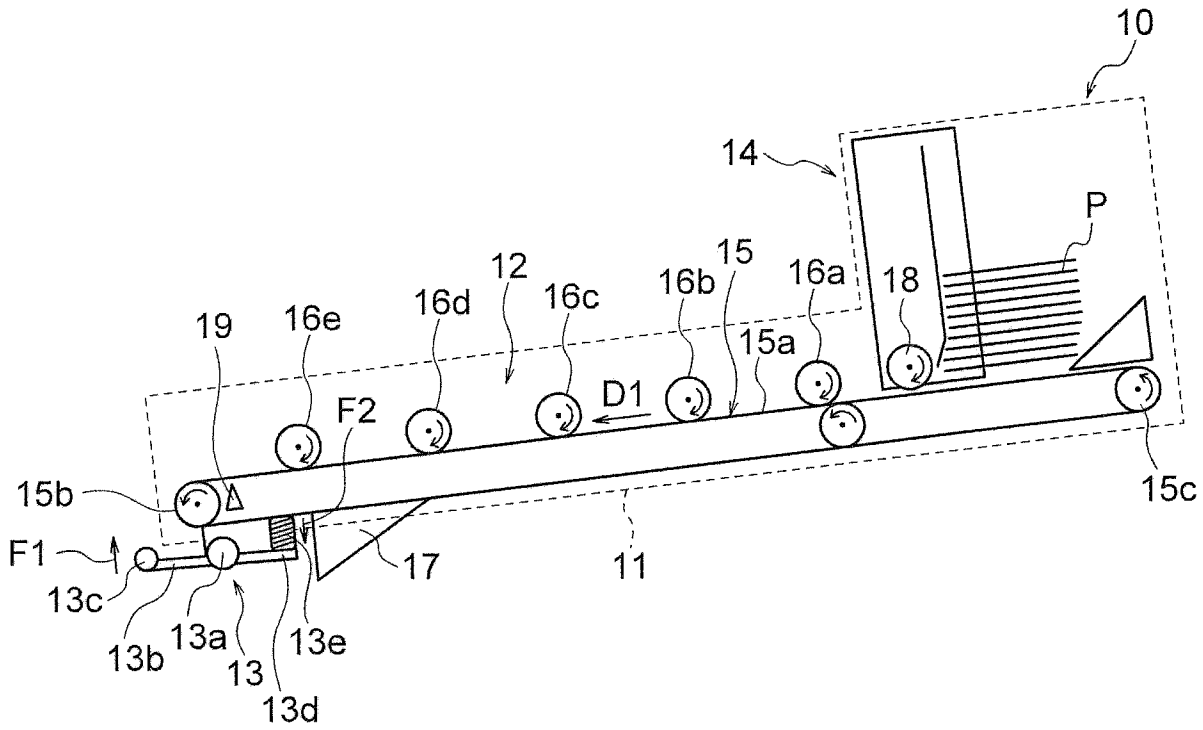
FIG. 5 is a cross-sectional view illustrating a schematic configuration of the medium supply device according to the first embodiment (in a state of not being attached to the MPT section)
Figure 6:
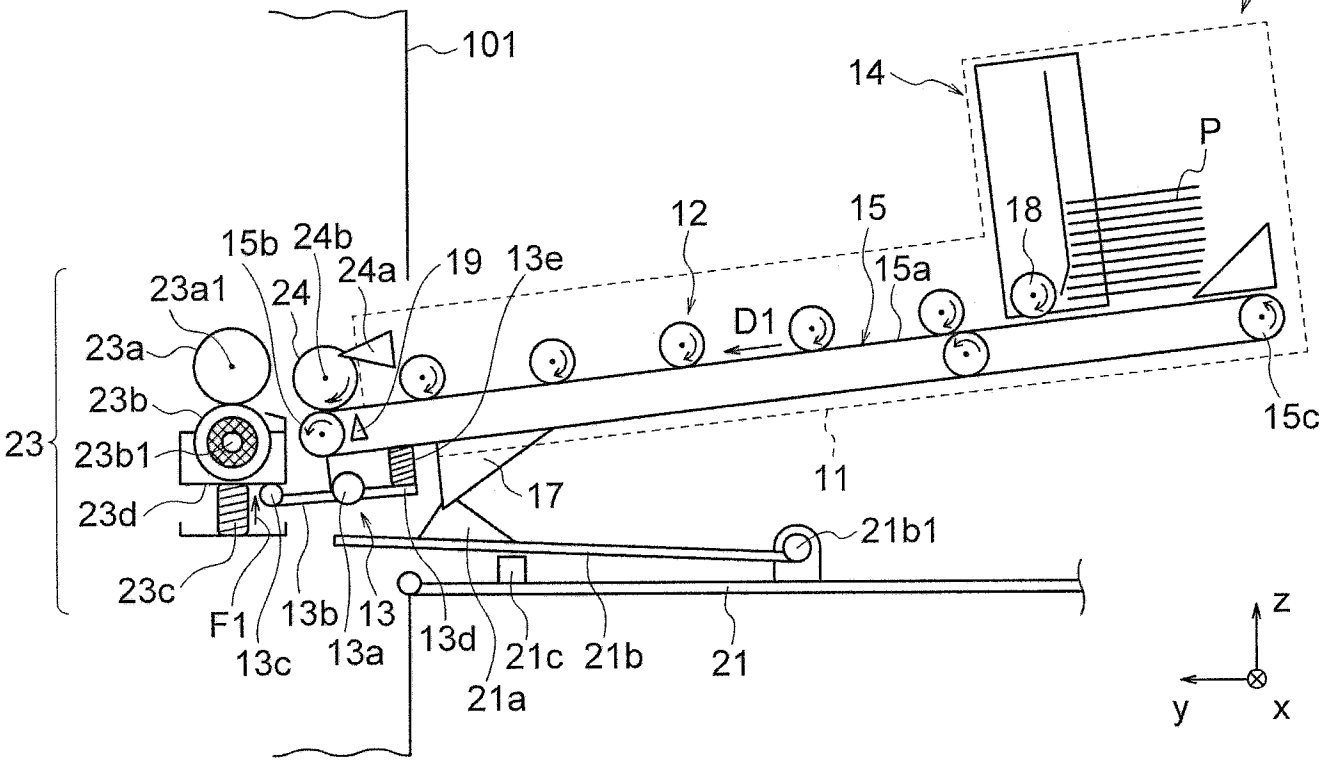
FIG. 6 is a cross-sectional view illustrating a schematic configuration of the medium supply device according to the first embodiment (in a state of being attached to the MPT section)

FIG. 5 is a cross-sectional view illustrating a schematic configuration of the medium supply device 10 according to the first embodiment (in a state of not being attached to the MPT section 20). FIG. 6 is a cross-sectional view illustrating a schematic configuration of the medium supply device 10 according to the first embodiment (in a state of being attached to the MPT section 20). As illustrated in FIGS. 5 and 6, the medium supply device 10 includes a frame unit 11 that can be removably attached to (installed in) the MPT section 20 of the apparatus body 101 of the image forming apparatus 100, and a medium conveying mechanism 12 that is provided in the frame unit 11 and conveys the recording media P one by one (in the conveying direction D1) to a predetermined position facing the pickup roller 24. The medium supply device 10 also includes a pressing mechanism 13 provided in the frame unit 11 and serving as a first mechanism that applies a first force F1 (i.e., an upward force in a thickness (height) direction of the frame unit 11 orthogonal to the conveying direction in the frame unit 11) of pressing the retard roller 23*b* against the feed roller 23*a* when the frame unit 11 is attached to the medium receiving port 22 as shown in FIG. 4, and a medium loading unit 14 on which a plurality of recording media P are stacked. The pressing mechanism 13 as the first mechanism reduces a braking force generated in the medium separating mechanism 23.

The medium conveying mechanism 12 of the medium supply device 10 includes a belt mechanism 15 that applies a conveying force in the conveying direction D1 to the recording medium P, for example. The belt mechanism 15 includes an endless belt 15*a* and rollers 15*b* and 15*c* that support the belt 15*a* so that the belt 15*a* can move (travel). The medium conveying mechanism 12 includes one or more rollers 16 (16*a* to 16*e*) that apply a conveying force in the conveying direction D1 to the recording medium P. In FIG. 6, a paper feed roller 18 rotates to supply the recording media P stacked on the medium loading unit of the medium supply device 10 one by one in the conveying direction D1. The belt mechanism 15 and the rollers 16 arranged downstream from the paper feed roller 18 convey the recording medium P supplied from the paper feed roller 18 in the conveying direction D1. The medium supply device 10 includes a motor (not illustrated) as a driving force generating unit that drives the belt mechanism 15, the plurality of rollers 16, and the paper feed roller 18, a driving force transmission mechanism such as a gear or a belt that transmits a driving force of the motor to other units or mechanisms, and a control unit (e.g., control circuit) that drives the belt mechanism 15, the plurality of rollers 16, and the paper feed roller 18 so that the recording medium P is fed from the medium loading unit 14 to the predetermined position facing the pickup roller 24 when a medium sensor 19 detects the absence of a medium. The configuration of the medium conveying mechanism 12 is not limited to the configuration illustrated in FIGS. 5 and 6, and may be other configurations as long as the medium conveying mechanism 12 can be attached to (installed in) the MPT section 20 and the recording medium can be conveyed one by one from the plurality of stacked recording media P toward the MPT section 20.

The pressing mechanism 13 of the medium supply device 10 includes a support shaft 13*a* rotatably supported on the frame unit 11, a lever member 13*b* fixed to the support shaft 13*a*, and a compression spring 13*e* serving as an elastic member. The lever member 13*b* rotatably supported by the support shaft 13*a* has a first end (tip projection) 13*c* from which the first force F1 (upward force in the drawing) is transmitted to the retard roller 23*b* and a rear end (second end) 13*d* that receives a second force F2 for generating the first force F1.

The frame unit 11 may include a sensor projection 17 that presses the pressure sensor 21*a* on the sheet receiver 21*b* when the frame unit 11 is attached to the MPT section 20. A control unit (not illustrated) of the image forming apparatus 100 can detect that the recording medium P or the medium supply device 10 is present on the sheet receiver 21*b* of the MPT section 20 while the pressure sensor 21*a* is pressed.

<1-2> Operation

When a user attaches (installs) the medium supply device 10 to the MPT section 20 of the apparatus body 101 of the image forming apparatus 100, a tip end 13*c* of the lever member 13*b* of the pressing mechanism 13 provided in the frame unit 11 of the medium supply device 10 enters under the lower surface of the support unit 23*d* supporting the support shaft 23*b*1 of the retard roller 23*b* provided in the MPT section 20 and contacts the lower surface to lift the lower surface in the +z direction (in the upward direction in FIG. 6). At this time, since the rear end 13*d* of the lever member 13*b* is pressed (with the second force F2) by the compression spring 13*e* in a −z direction (in a downward direction in FIG. 6), the tip end 13*c* of the lever member 13*b* presses the lower surface of the support unit 23*d* in the +z direction (in the upward direction in FIG. 6) with the first force F1, and both a pressing force by the compression spring 23*c* and a pressing force by the tip end 13*c* are exerted on the support unit 23*d*. In this manner, the pressing force of the retard roller 23*b* acting on the feed roller 23*a* increases.

In the medium separating mechanism 23 including the retard roller 23*b*, a certain level of a braking force is, generated by a torque limiter coaxially provided in the support shaft 23*b*1 of the retard roller 23*b*. Typical elements for changing the braking force are a change of a torque value of the torque limiter and a change of a pressing force of the retard roller 23*b* acting on the feed roller 23*a*. That is, when the torque value of the torque limiter is set to a larger value, the braking force of the retard roller 23*b* in the medium separating mechanism 23 increases, whereas when the torque value of the torque limiter is set to a smaller value, the braking force of the retard roller 23*b* in the medium separating mechanism 23 decreases. When the pressing force of the retard roller 23*b* acting on the feed roller 23*a* is increased, a braking force exerted by the retard roller 23*b* on the recording medium P decreases. In the first embodiment, as the pressing force of the retard roller 23*b* acting on the feed roller 23*a*, not only the pressing force by the compression spring 23*c* but also the pressing force by the tip end 13*c* of the pressing mechanism 13 is exerted on the support unit 23*d* of the retard roller 23*b*, and thus, the braking force (force in the direction opposite to the conveying direction D1) exerted by the medium separating mechanism 23 decreases.

After a user has attached the medium supply device 10 to the image forming apparatus 100, the user places a plurality of recording media P on the medium loading unit 14 and performs an operation for starting printing so that the recording media P stacked on the medium loading unit 14 are fed one by one by the paper feed roller 18 and supplied through the medium conveying mechanism 12 to the predetermined position facing the pickup roller 24 of the image forming apparatus 100.

When the medium sensor 19 disposed near a front end of the belt 15*a* detects the presence of a recording medium P and outputs a detection signal indicating the presence of a recording medium P, the medium supply device 10 stops a medium feed operation (paper feed operation). When the medium sensor 19 detects the absence of a recording medium after the recording medium P is conveyed from a position of the medium sensor 19 and outputs a detection signal indicating the absence of a recording medium P, the medium supply device 10 starts the paper feed operation again.

When the pressure sensor 21*a* is pressed by the sensor projection 17 and apparently detects the presence of a recording medium and the medium conveying mechanism 12 shifts the pickup roller 24 so that the position sensor 24*a* of the pickup roller 24 detects a paper feedable state, the image forming apparatus 100 starts printing operation in accordance with a print instruction from a host system.

When the recording media P that have been conveyed from the medium supply device 10 to, and stop at the front end of the medium conveying mechanism 12, that is, a position immediately under the pickup roller 24 of the image forming apparatus 100 are fed between the feed roller 23*a* and the retard roller 23*b* (between the paired rollers) by driving the pickup roller 24, the recording media travel one by one downstream in the conveying direction. Thereafter, each recording medium P passes through the image forming units 110K, 110Y, 110M, and 110C in which toner images are formed on the recording medium P, passes through the fixing unit 150 in which the toner images are fixed on the recording medium P, and then is ejected to a stacker outside the apparatus body 101.

At this time, when the recording medium is fed by the pickup roller 24 into the apparatus body 101, the medium sensor 19 detects the absence of a recording medium. Thus, the medium supply device 10 starts the paper feed operation again, feeds the next recording medium P to the position at which the medium sensor 19 detects the presence of a recording medium (the position facing the pickup roller 24), and then stops the operation. In the case of printing a plurality of recording media in accordance with a print command to the image forming apparatus 100, the recording media are conveyed one by one sequentially to the image forming units 110K, 110Y, 110M, and 110C so that image formation is performed on each recording medium, in a manner similar to the initial recording medium. As described above, recording medium supply operations and an image forming operations are repeated.

<1-3> Advantages

As described above, in the first embodiment, the pressing mechanism 13 can increase the pressing force of the retard roller 23*b* acting on the feed roller 23*a* only by attaching (installing) the medium supply device 10 to the MPT section 20 of the image forming apparatus 100. Thus, the braking force generated by the feed roller 23*a* and the retard roller 23*b* can be reduced so that occurrence of jams of special media such as envelopes having flaps can be reduced.

<2> Second Embodiment

In the first embodiment described above, when the medium supply device 10 is attached to the image forming apparatus 100, the medium conveying mechanism 12 of the medium supply device 10 presses the pickup roller 24 to change the position of the pickup roller 24 in the z direction, and the position sensor 24*a* apparently detects the state indicating the presence of a recording medium by detecting the position of the pickup roller 24 in the z direction. On the other hand, in the second embodiment of the present invention, the elevation mechanism 21*c* that elevates and lowers a sheet receiver 21*b* of the MPT tray 21 in the z direction may be used so that a medium conveying mechanism 12 rotates about a support shaft of a roller 15*c* (in a direction D2 in FIG. 7) and, thereby, the position of a pickup roller 24 in the z direction is changed.

Figure 7:
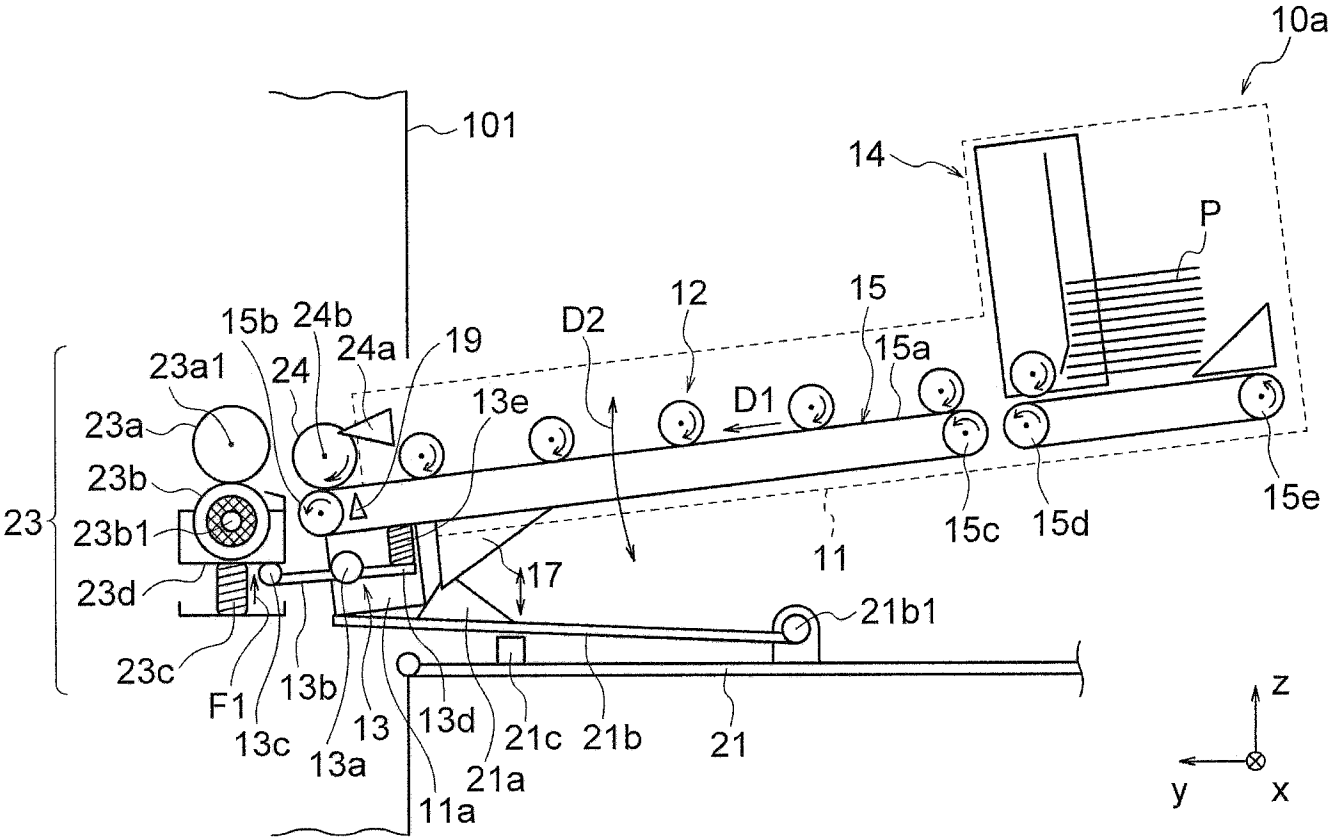
FIG. 7 is a cross-sectional view illustrating a schematic configuration of a medium supply device according to a second embodiment of the present invention (in a state of being attached to an MPT section)

FIG. 7 is a cross-sectional view illustrating a schematic configuration of a medium supply device 10*a* according to the second embodiment (when the medium supply device 10*a* is attached to the MPT section 20).

In FIG. 7, constitutional elements that are the same as or correspond to those shown in FIG. 6 (first embodiment) are designated by the same reference characters as those shown in FIG. 6. As illustrated in FIG. 7, the medium conveying mechanism 12 has a rotation axis near a medium loading unit 14 (near a center axis position of the roller 15*c*) and is configured to be rotatable (in the direction D2), and a structure 11*a* that contacts the upper surface of a sheet receiver 21*b* is provided under the medium conveying mechanism 12 in the frame unit 11 of the medium supply device 10*a*. When the medium supply device 10*a* is attached to the image forming apparatus 100, an elevation operation of the sheet receiver 21*b* of the MPT tray 21 (rotation operation about the support shaft 21*b*1) causes the structure 11*a* to lift and rotate the medium conveying mechanism 12, and the front end thereof is raised so that the pickup roller 24 is shifted in the +z direction. When the position of the pickup roller 24 is raised to a position indicating the presence of a recording medium, a tip end 13*c* of a pressing mechanism 13 presses a contact portion of the lower surface of the support unit 23*d* of the retard roller 23*b* in the +z direction (in the upward direction in FIG. 7) accordingly. Except for the above-described points, the configurations of the second embodiment are the same as those described in the first embodiment.

In the second embodiment, advantages similar to those of the first embodiment can be obtained. In addition, in the second embodiment, although the configuration is more complicated than that of the first embodiment, a strong pressing force by the pressing mechanism 13 can be applied to the lower surface of the support unit 23*d* of the retard roller 23*b* so that occurrence of jams can be surely reduced.

<3> Third Embodiment

In the first and second embodiments, the pressing mechanism 13 is provided in the frame unit (first frame unit) 11. On the other hand, in the third embodiment of the present invention, the medium conveying mechanism 12 is provided in a frame unit (first frame unit) 11, and the pressing mechanism 13 is provided in a conveyance guide unit (second frame unit) 31.

Figure 8A:
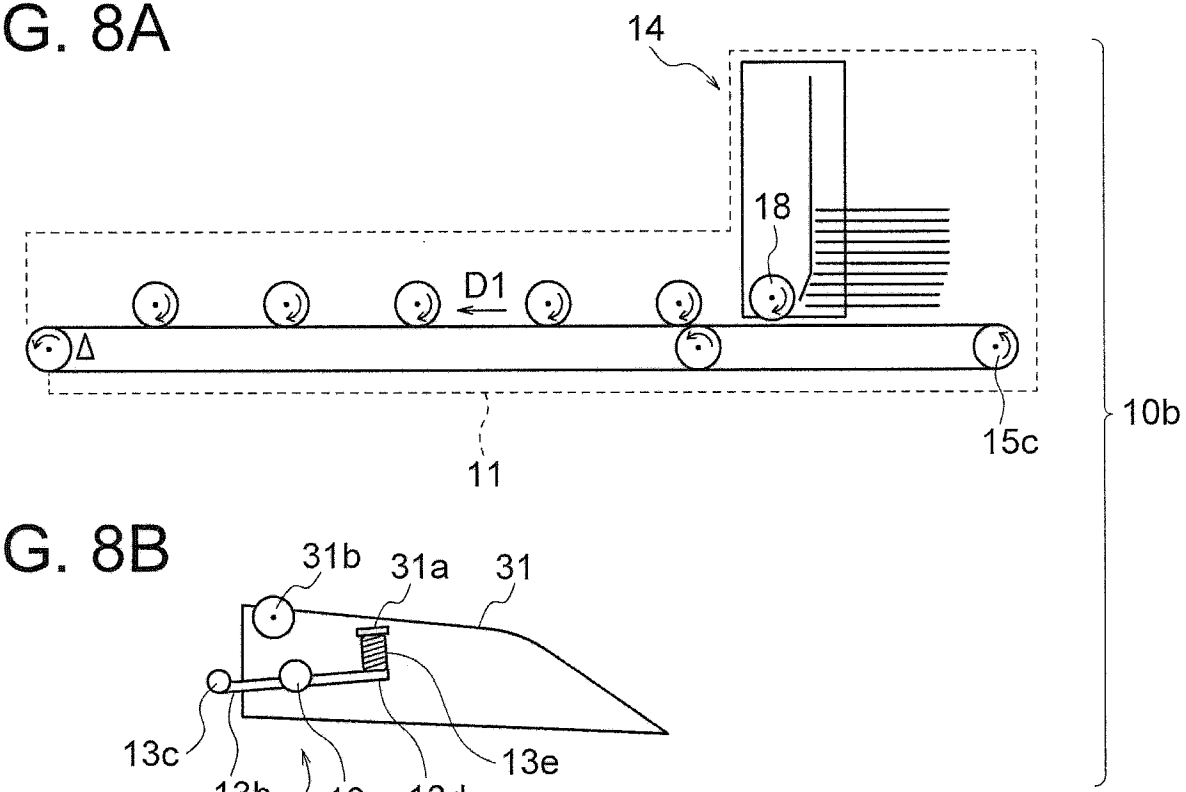
FIGS. 8A and 8B are cross-sectional views illustrating a schematic configuration of a medium supply device according to a third embodiment of the present invention (in a state of not being attached to an MPT section)
Figure 8B:
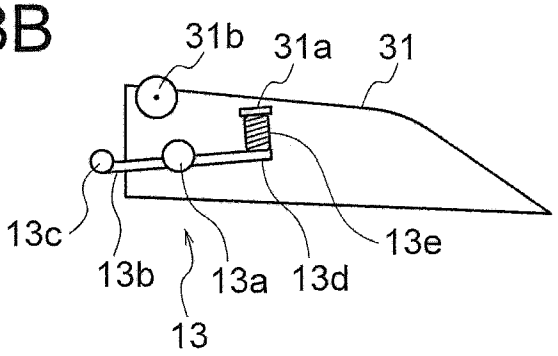
Figure 9:
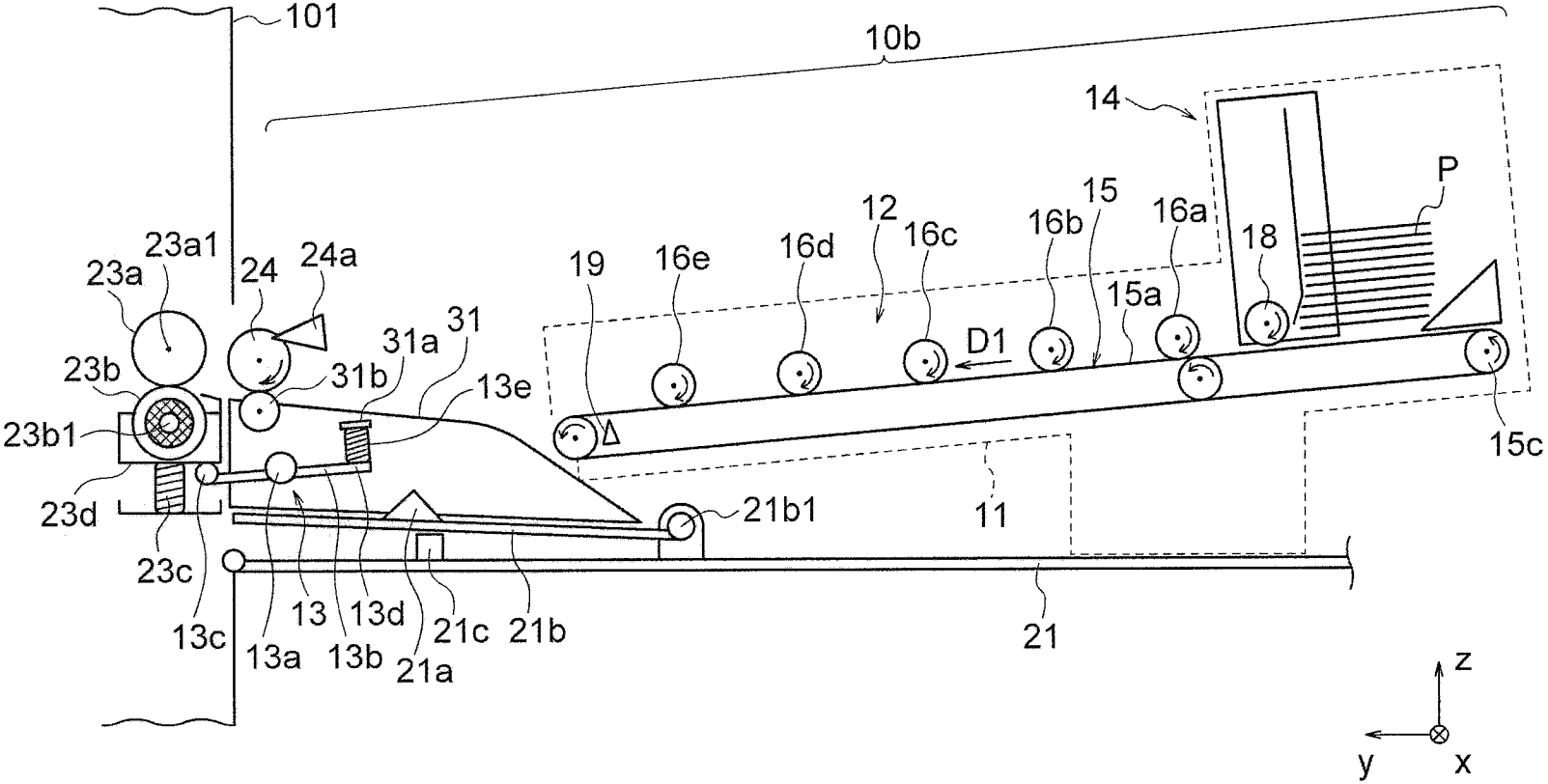
FIG. 9 is a cross-sectional view illustrating a schematic configuration of the medium supply device according to the third embodiment (in a state of being attached to the MPT section)

FIGS. 8A and 8B are cross-sectional views illustrating a schematic configuration of a medium supply device 10*b* according to the third embodiment (in a state of not being attached to the MPT section 20). In FIGS. 8A and 8B, constitutional elements that are the same as or correspond to those shown in FIG. 5 (first embodiment) are designated by the same reference characters as those shown in FIG. 5. FIG. 9 is a cross-sectional view illustrating a schematic configuration of the medium supply device 10*b* according to the third embodiment (in a state of being attached to the MPT section 20). In FIG. 9, constitutional elements that are the same as or correspond to those shown in FIG. 6 (first embodiment) are designated by the same reference characters as those shown in FIG. 6.

As illustrated in FIGS. 8A and 8B, the medium supply device 10*b* according to the third embodiment includes a first unit including the frame unit (first frame unit) 11 illustrated in FIG. 8A and a second unit including the conveyance guide unit (second frame unit) 31 illustrated in FIG. 8B. The first and second units are separated from each other. The first unit illustrated in FIG. 8A is the same as the medium supply device 10 according to the first embodiment except that the shape of the frame unit 11 is different. The frame unit 11 of the first unit illustrated in FIG. 8A is formed to have a shape that can be attached onto the MPT section 20. The second unit illustrated in FIG. 8B includes the conveyance guide unit 31, a spring fixing part 31*a* provided in the conveyance guide unit 31, a roller 31*b* rotatably supported on the conveyance guide unit 31, and the pressing mechanism 13 including a support shaft 13*a* rotatably supported on the conveyance guide unit 31. The configuration of the pressing mechanism 13 is the same as that of the first embodiment.

As illustrated in FIG. 9, when a user attaches (installs) the second unit illustrated in FIG. 8B onto the sheet receiver 21*b*, the tip end 13*c* of the pressing mechanism 13 contacts the bottom surface of the support unit 23*d* supporting the retard roller 23*b* so that a pressing force in the +z direction is applied to the support unit 23*d*, in a manner similar to the first embodiment. Thereafter, when the user attaches (installs) the first unit illustrated in FIG. 8A to the MPT section, the state illustrated in FIG. 9 is established. As illustrated in FIG. 9, the medium supply device 10*b* according to the third embodiment can be used by using the combination of the separated two units attached to the MPT section 20 of an apparatus body 101. The recording medium P conveyed in the conveying direction D1 by the medium conveying mechanism 12 is guided by the upper surface of the conveyance guide unit 31 to move forward, and stops so that the front end of the recording medium is located at the position facing a pickup roller 24. The position detection at this time can be performed by using the medium sensor 19 or another sensor which is not illustrated. When the medium sensor 19 detects the absence of a recording medium, a new recording medium is conveyed from the medium loading unit 14, and it stops so that the frond end of the new recording medium is located at a predetermined position facing the pickup roller 24. In the third embodiment, advantages similar to those of the first embodiment can be obtained.

<4> Fourth Embodiment

In the first embodiment, the medium separating mechanism is a retard-type separating mechanism. However, as described below, the present invention is also applicable to an image forming apparatus having a separation-pad-type medium separating mechanism.

Figure 10:
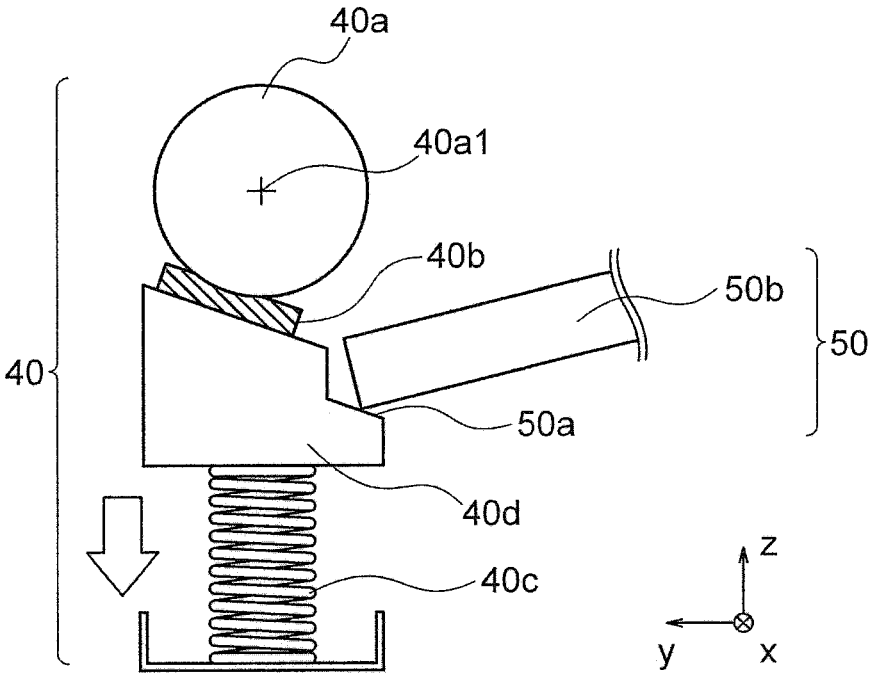
FIG. 10 is a cross-sectional view illustrating a schematic configuration of a medium separating mechanism in an image forming apparatus according to a fourth embodiment of the present invention.
Figure 11:
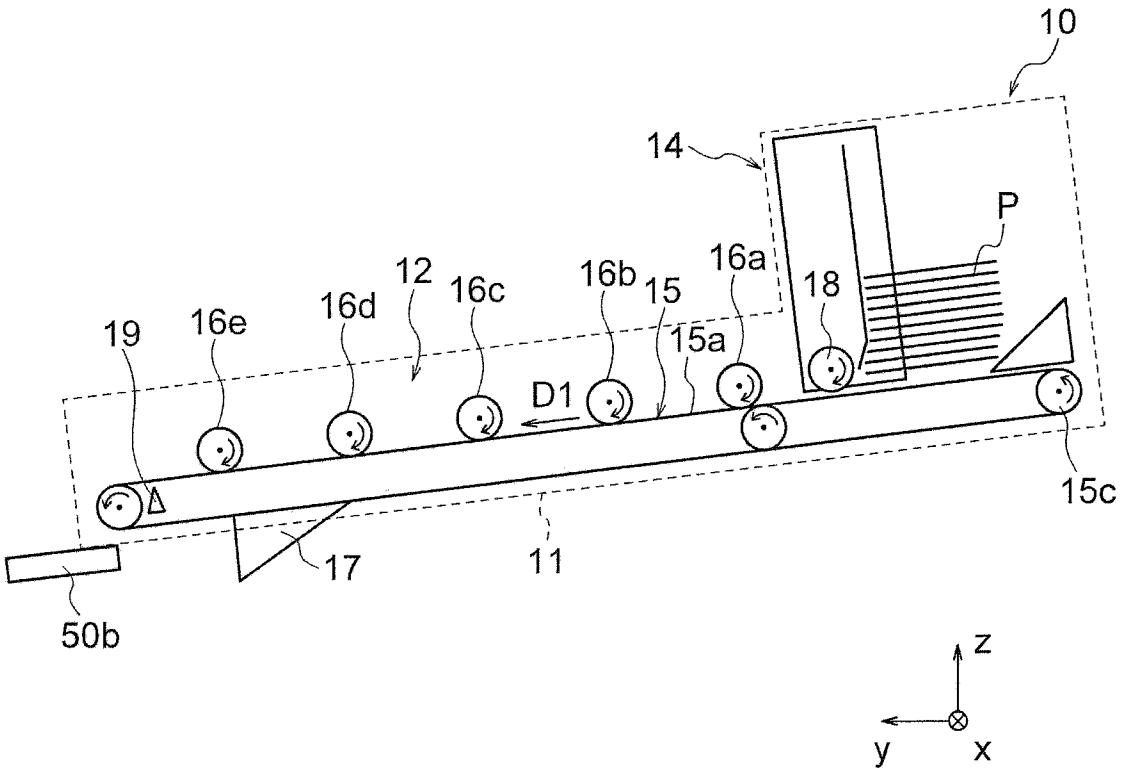
FIG. 11 is a cross-sectional view illustrating a schematic configuration of a medium supply device configured to be attached to the image forming apparatus according to the fourth embodiment (in a state of not being attached to an MPT section).

FIG. 10 is a cross-sectional view illustrating a schematic configuration of a medium separating mechanism 40 in an image forming apparatus according to the fourth embodiment of the present invention. FIG. 11 is a cross-sectional view illustrating a schematic configuration of a medium supply device configured to be attached to the image forming apparatus according to the fourth embodiment (in a state of not being attached to an MPT section). In FIG. 11, constitutional elements that are the same as or correspond to those shown in FIG. 6 (first embodiment) are designated by the same reference characters as those shown in FIG. 6.

The image forming apparatus according to the fourth embodiment is different from the image forming apparatus according to the first embodiment in including the medium separating mechanism 40 illustrated in FIG. 10 instead of the medium separating mechanism 23 in FIG. 6 (first embodiment) and in including a pressing-force reduction mechanism (first mechanism) 50 illustrated in FIGS. 10 and 11 instead of the pressing mechanism 13 in FIG. 6 (first embodiment). Except for these points, the fourth embodiment is the same as the first embodiment. Thus, in the description of the fourth embodiment, FIG. 6 is also referred.

As illustrated in FIG. 10, the medium separating mechanism 40 according to the fourth embodiment includes a feed roller 40*a* that is driven to rotate about a support shaft 40*a*1, a separation pad 40*b* disposed at a position facing the feed roller 40*a*, a holder 40*d* that holds the separation pad 40*b* and can be shifted (can move) in the z direction, and a compression spring 40*c* having, one end supported on the apparatus body 101 and the other end in contact with the holder 40*d*. With rotation of the feed roller 40*a*, the recording media are fed one by one in a +y direction between the feed roller 40*a* and the separation pad 40*b*.

In the case of the separation-pad-type medium separating mechanism 40, to reduce a braking force generated in the medium separating mechanism 40 (force exerted on the recording media in a −y direction), the pressing-force reduction mechanism 50 that reduces a pressing force of the separation pad 40*b* against the feed roller 40*a* is provided.

The pressing-force reduction mechanism 50 includes a surface part 50*a* formed in the holder 40*d*, and a projecting part 50*b* (i.e., a contact part for pushing the surface part 50*a* downward) fixed in the medium supply device 10 illustrated in FIG. 11. When the medium supply device 10 is attached to the apparatus body 101, the projecting part 50*b* contacts the surface part 50*a* as illustrated in FIG. 10. The holder 40*d* is provided in the apparatus body in such a manner that the holder 40*d* is not shifted in the y direction but can be shifted in the z direction. Thus, when the projecting part 50*b* contacts the surface part 50*a*, the holder 40*d* holding the separation pad 40*b* is pushed down in a direction indicated by an arrow (−z direction). When the holder 40*d* is pushed down, a pressing force of the separation pad 40*b* against the feed roller 40*a* decreases, and a braking force generated by the feed roller 40*a* and the separation pad 40*b* decreases.

As described above, in the fourth embodiment, the pressing-force reduction mechanism 50 can reduce a pressing force of the separation pad 40*b* acting on the feed roller 40*a* only by attaching (installing) the medium supply device 10 including the projecting part 50*b* to the MPT section 20 of the image forming apparatus 100. Thus, a braking force generated by the feed roller 40*a* and the separation pad 40*b* can be reduced so that occurrence of jams of special media such as envelopes having flaps can be reduced.

<5> Application Mode

The present invention is applicable to various apparatuses to each of which a medium supply device for conveying recording media placed thereon is attached as an external paper feed device. Furthermore, the image forming technique of the image forming apparatus to which the present invention is applicable is not limited to electrophotography, and may be other print techniques such as an ink jet technique.

Description of Symbols is as follows:

10, 10*a*, 10*b*: medium supply device, 11: frame unit (first frame unit), 12: medium conveying mechanism, 13: pressing mechanism, 13*a*: support shaft, 13*b*: lever member, 13*c*: tip projection (first end), 13*d*: rear end (second end), 13*e*: compression spring (elastic member), 14: medium loading unit, 15: belt mechanism, 15*a*: belt, 15*b*, 15*c*: roller, 16 (16*a* to 16*e*): roller, 17: sensor projection, 18: paper feed roller, 19: medium sensor, 20: multi-purpose tray (MPT) section, 21: MPT tray, 21*a*: pressure sensor, 21*b*: sheet receiver, 21*b*1: support shaft, 21*c*: elevation mechanism, 22: medium receiving port, 23: medium separating mechanism, 23*a*: feed roller (first roller, paper feed roller), 23*a*1: support shaft (shaft), 23*b*: retard roller (second roller, separating roller), 23*b*1: support shaft (shaft), 23*c*: compression spring (elastic member), 23*d*: support unit (attachment frame), 24: pickup roller, 31: conveyance guide unit (second frame unit), 31*a*: spring fixing part, 31*b*: roller, 40: medium separating mechanism, 40*a*: feed roller, 40*b*: separation pad, 40*c*: compression spring, 40*d*: holder, 50: pressing-force reduction mechanism, 50*a*: surface part, 50*b*: projecting part, 100: image forming apparatus, and 101: image forming apparatus body (apparatus body).

What is claimed is:

1. A medium supply device that is configured to be attached to an image forming apparatus body including a medium separating mechanism which comprises a first and a second roller, the medium supply device comprising:

a medium conveying mechanism configured to supply a recording medium from stacked recording media, through a position between the first and second rollers and to a predetermined position; and a pressing mechanism applying a first force to the second roller and causing the second roller to press against the first roller, wherein when a pressing force of the second roller acting on the first roller is increased by the pressing mechanism, a braking force exerted by the second roller on the recording medium decreases.

2. The medium supply device according to claim 1, wherein:

the medium separating mechanism includes a first separation pad that is pressed against the first roller, and a pressing-force reduction mechanism that reduces a pressing force of the first separation pad against the first roller.

3. The medium supply device according to claim 1, further comprising:

a first frame unit that supports the medium conveying mechanism and is configured to be attached to the image forming apparatus body.

4. The medium supply device according to claim 1, further comprising:

a first frame unit that supports the medium conveying mechanism and is configured to be attached to the image forming apparatus body; and a second frame unit that is configured to be attached to the image forming apparatus body, wherein:

the pressing mechanism includes a support shaft rotatably supported on the second frame unit, a lever member fixed to the support shaft and having a first end from which the first force is transmitted to the second roller and a second end that receives a second force for generating the first force, and an elastic member that applies the second force to the second end.

5. The medium supply device according to claim 1, wherein:

the image forming apparatus body further includes a tray that opens and closes a medium receiving port, and the medium supply device is configured to be attached onto the tray in an open state.

6. The medium supply device according to claim 1, wherein:

the image forming apparatus body further includes a pickup roller that conveys the recording medium placed at the predetermined position toward the medium separating mechanism, and the predetermined position is a position facing the pickup roller.

7. The medium supply device according to claim 1, further comprising:

a medium sensor that detects presence of a recording medium placed at the predetermined position of the medium conveying mechanism; and a driving force generating unit that supplies a driving force to the medium conveying mechanism, wherein when a detection signal output from the medium sensor is switched from a state indicating presence of a recording medium to another state indicating absence of a recording medium, the driving force generating unit and the medium conveying mechanism are controlled so that a Previously Presented recording medium is supplied to the predetermined position.

8. The medium supply device according to claim 1, wherein:

the second roller includes a torque limiter coaxially provided in a support shaft of the second roller, and when the first force is increased, the braking force generated by the torque limiter and exerted by the second roller on the recording medium decreases.

9. A medium supply device that is configured to be attached to an image forming apparatus body including a medium separating mechanism, the medium supply device comprising:

a medium conveying mechanism that supplies a recording medium from stacked recording media to a predetermined position; and a first mechanism that reduces a braking force generated in the medium separating mechanism a first frame unit that supports the medium conveying mechanism and is configured to be attached to the image forming apparatus body, wherein:

the medium separating mechanism includes first and second rollers, each rotatable about a respective central axis thereof, and whose outer peripheral surfaces are in contact with each other, the first mechanism is a pressing mechanism that applies a first force to the second roller, thereby causing the second roller to press against the first roller, and the pressing mechanism includes a support shaft rotatably supported on the first frame unit, a lever member fixed to the support shaft and having a first end from which the first force is transmitted to the second roller and a second end that receives a second force for generating the first force, and an elastic member that applies the second force to the second end.

10. An image forming apparatus comprising:

an image forming apparatus body including a medium separating mechanism which comprises a first and a second roller; and a medium supply device attached to the image forming apparatus body, wherein the medium supply device includes a medium conveying mechanism configured to supply a recording medium from stacked recording media, through a position between the first and second rollers and to a predetermined position, and a pressing mechanism applying a first force to the second roller and causing the second roller to press against the first roller, wherein when a pressing force of the second roller acting on the first roller is increased by the pressing mechanism, a braking force exerted by the second roller on the recording medium decreases.

11. The image forming apparatus according to claim 10, wherein:

the medium separating mechanism includes a first separation pad that is pressed against the first roller, and is a pressing-force reduction mechanism that reduces a pressing force of the first separation pad against the first roller.

12. The image forming apparatus according to claim 10, wherein the medium supply device further includes a first frame unit that supports the medium conveying mechanism and is configured to be attached to the image forming apparatus body.

13. The image forming apparatus according to claim 10, wherein:

the medium supply device further includes a first frame unit that supports the medium conveying mechanism and is configured to be attached to the image forming apparatus body, and a second frame unit that is configured to be attached to the image forming apparatus body, and the pressing mechanism includes a support shaft rotatably supported on the second frame unit, a lever member fixed to the support shaft and having a first end from which the first force is transmitted to the second roller and a second end that receives a second force for generating the first force, and an elastic member that applies the second force to the second end.

14. The image forming apparatus according to claim 10, wherein:

the image forming apparatus body further includes a tray that opens and closes a medium receiving port, and the medium supply device is configured to be attached onto the tray in an open state.

15. The image forming apparatus according to claim 10, wherein:

the image forming apparatus body further includes a pickup roller that conveys the recording medium placed at the predetermined position toward the medium separating mechanism, and the predetermined position is a position facing the pickup roller.

16. The image forming apparatus according to claim 10, wherein:

the medium supply device further includes a medium sensor that detects presence of a recording medium placed at the predetermined position of the medium conveying mechanism, and a driving force generating unit that supplies a driving force to the medium conveying mechanism, and when a detection signal output from the medium sensor is switched from a state indicating presence of a recording medium to another state indicating absence of a recording medium, the driving force generating unit and the medium conveying mechanism are controlled so that a Previously Presented recording medium is supplied to the predetermined position.

17. The image forming apparatus according to claim 10, wherein:

the second roller includes a torque limiter coaxially provided in a support shaft of the second roller, and when the first force is increased, the braking force generated by the torque limiter and exerted by the second roller on the recording medium decreases.

18. An image forming apparatus comprising:

an image forming apparatus body including a medium separating mechanism; and a medium supply device attached to the image forming apparatus body, wherein the medium supply device includes a medium conveying mechanism that supplies a recording medium from stacked recording media to a predetermined position, and a first mechanism that reduces a braking force generated in the medium separating mechanism, and a first frame unit that supports the medium conveying mechanism and is configured to be attached to the image forming apparatus body, wherein:

the medium separating mechanism includes first and second rollers, each rotatable about a respective central axis thereof, and whose outer peripheral surfaces are in contact with each other, the first mechanism is a pressing mechanism that applies a first force to the second roller, thereby causing the second roller to press against the first roller, and the pressing mechanism includes a support shaft rotatably supported on the first frame unit, a lever member fixed to the support shaft and having a first end from which the first force is transmitted to the second roller and a second end that receives a second force for generating the first force, and an elastic member that applies the second force to the second end.

* * * * *